United States Patent [19]

Schour et al.

[11] Patent Number: 4,510,701

[45] Date of Patent: Apr. 16, 1985

[54] ATHLETIC SHOE AND COUNTER

[75] Inventors: Avi Schour; Igal Bloch, both of Boca Raton, Fla.

[73] Assignee: H. H. Brown Shoe Co., Inc., New York, N.Y.

[21] Appl. No.: 504,614

[22] Filed: Jun. 15, 1983

[51] Int. Cl.[3] ..... A43B 13/41

[52] U.S. Cl. ..... 36/68; 36/69; 36/132

[58] Field of Search ..... 36/132, 68, 69, 113, 36/128, 129, 115

[56] References Cited

U.S. PATENT DOCUMENTS

| | | | |
|---|---|---|---|
| 2,505,593 | 4/1950 | Stout | 36/68 |
| 2,523,221 | 9/1950 | Maloy | 36/68 |
| 2,693,740 | 11/1954 | Cooper | 36/68 |
| 2,789,374 | 4/1957 | Planert | 36/132 |
| 3,306,610 | 2/1967 | Biggs | 36/132 |
| 4,245,408 | 1/1981 | Larsen | 36/50 |
| 4,282,659 | 8/1981 | Bourque | 36/117 |
| 4,287,675 | 9/1981 | Norton | 36/129 |
| 4,305,212 | 12/1981 | Coomer | 36/69 |

FOREIGN PATENT DOCUMENTS

| | | | |
|---|---|---|---|
| 1124060 | 6/1982 | Canada | 36/115 |
| 329451 | 6/1930 | United Kingdom . | |

OTHER PUBLICATIONS

*Footwear News Magazine,* Feb. 1983.

Aerodancer North Star, Mar. 3, 1983.

*Primary Examiner*—Henry S. Jaudon

*Assistant Examiner*—Mary A. Ellis

*Attorney, Agent, or Firm*—W. R. Hulbert

[57] ABSTRACT

A laced athletic shoe includes an external, cup-form counter having eyelets defined in its forwardly extending surfaces adapted to receive the ends of shoelaces extending from the laced portion of the shoe. The cup-form counter extends about the heel portion of the shoe upper along the rear and sides of the upper and also below the wearer's heel above the sole. When the laces are drawn tightly, the counter cupping the wearer's heel through the upper is drawn toward the laced portion to snug the shoe about the wearer's foot to restrict undesired movement of the foot within the shoe. The external cup-form counter with side eyelets is also claimed separately.

6 Claims, 4 Drawing Figures

FIG. 1
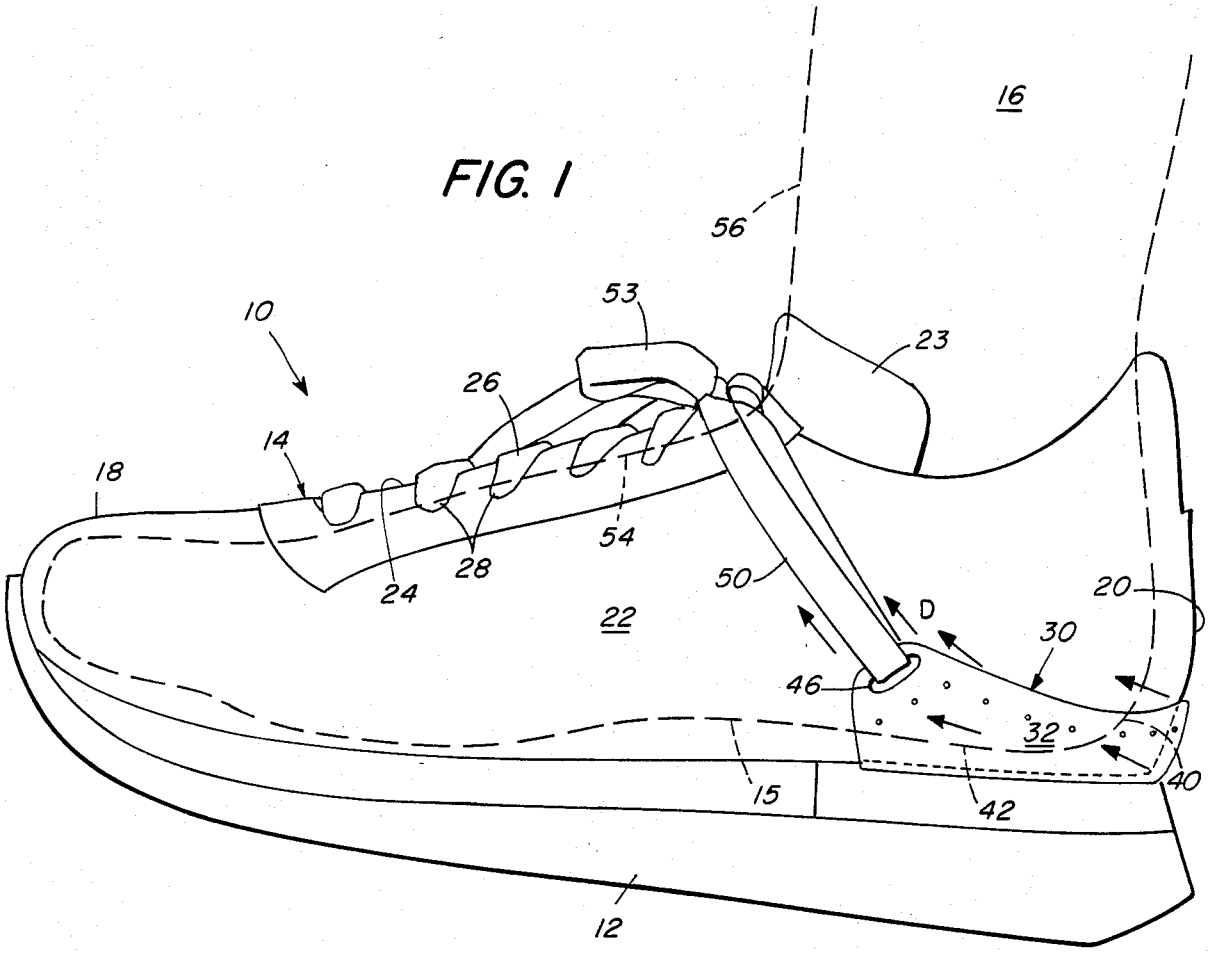
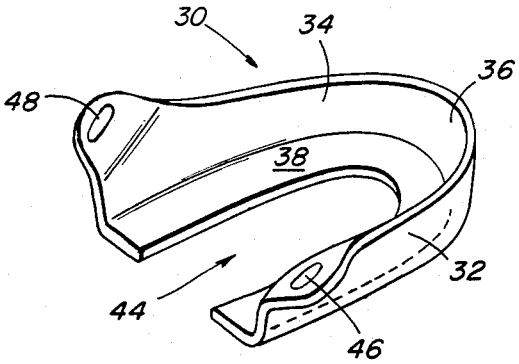
FIG. 3

ATHLETIC SHOE AND COUNTER

BACKGROUND OF THE INVENTION

The invention relates to laced athletic shoes.

Shoes for use during athletics must provide positive support for the athlete, at times during rapid and sudden changes of direction, and also be of light weight construction to minimize fatigue. These requirements operate at cross purposes, as the lighter weight fabrics typically used in athletic shoe uppers cannot provide adequate support. Thus during motion, the wearer's foot tends to slide about in the shoe upper, above the sole.

In laced shoes, the laces may be pulled tightly to locally draw the shoe about the wearer's foot, but transverse movement of the heel and toe portions of the foot in the shoe is typically not adequately restricted. Rigid external shoe counters have been provided in athletic shoes in attempts to reduce transverse movement of the wearer's heel, e.g., as shown in Riddell U.S. Pat. No. 2,244,504; in Bowerman, U.S. Pat. No. 2,255,877; and in Norton et al., U.S. Pat. No. 4,288,929. Axial movement also occurs, particularly if the wearer's heel is not held against the rear of the upper when the laces are tightened.

Furthermore, the laces quickly become loosened during athletic activity.

Athletes in some sports have addressed this problem by using overly long shoelaces with the ends wrapped about the shoe, e.g., around the ankle or beneath the sole, to extend the localized effect of the laces to more tightly secure the shoe to the foot in the lace area. A number of patents show shoes with grommets, loops or extra straps to provide this effect, e.g., Hansen U.S. Pat. No. 859,382; Manss U.S. Pat. No. 752,173; Morgan, Jr., et al. U.S. Pat. No. 2,806,300; Kunzli U.S. Pat. No. 3,138,880; and Larsen et al. U.S. Pat. No. 4,245,408.

SUMMARY OF THE INVENTION

The invention concerns a laced athletic shoe comprising a sole, and a shoe upper, connected to the sole adapted to receive and confine a wearer's foot, having a toe portion, a heel portion and an intermediate connecting portion therebetween including a U-shaped opening extending rearwardly from proximate the toe portion secured by laces extending between lace-engaging eyelets along the opening periphery, the heel portion including a counter having at least a rearward portion and forwardly extending side portions, and further including a pair of side eyelets affixed to the forwardly extending side portions of the counter for receiving the lace end portions therethrough, whereby when the laces are drawn tightly through the eyelets, the intermediate connecting portion and the heel portion in the vicinity of the side eyelets are drawn close to the wearer's foot.

According to the invention, the counter is a rigid external counter of cup-form configuration, including a base portion extending from the rearward and forwardly extending side portions beneath the wearer's foot above the sole, and the heel portion side eyelets are defined in the forwardly extending surfaces of the external cup-form counter, whereby when the laces are drawn tightly, the rigid cup-form counter is drawn against the immediate bottom rear portion of the wearer's foot and the rearward and upwardly extending side portions of the counter are drawn against the rear and side portions of the wearer's foot, all in the direction of the laced upper intermediate connecting portion of the shoe to snugly grip the shoe about opposed sides of the wearer's foot to eliminate movement of the foot within the shoe.

In preferred embodiments, the counter is formed of synthetic material and the side eyelets are defined integrally therein; a forwardly directed aperture is defined in the base surface of the external counter to enable the forwardly extending side portions of the counter to independently move to closely conform to the sides of the wearer's foot when the laces are drawn tightly; at least a portion of the surface of the external counter defining the side eyelet is disposed at an angle outward from the side surface of the heel portion to facilitate passage of the laces therethrough; and the height of each side portion of the external counter above the sole in the region of the respective side eyelet is greater than the height of the side portion at a point more remote from the eyelet.

An external counter of the above description for use in laced athletic shoes is also claimed.

The object of the invention is to provide a laced athletic shoe which may be drawn tightly about the wearer's foot to provide positive support, e.g., during turning movement.

PREFERRED EMBODIMENT

A preferred embodiment of the invention will now be described, after first briefly describing the drawings.

DRAWINGS

FIG. 1 is a side view of an athletic shoe with an external counter laced according to the invention;

FIG. 3 is a prospective view of the external counter according to the invention.

STRUCTURE

Figure 2:
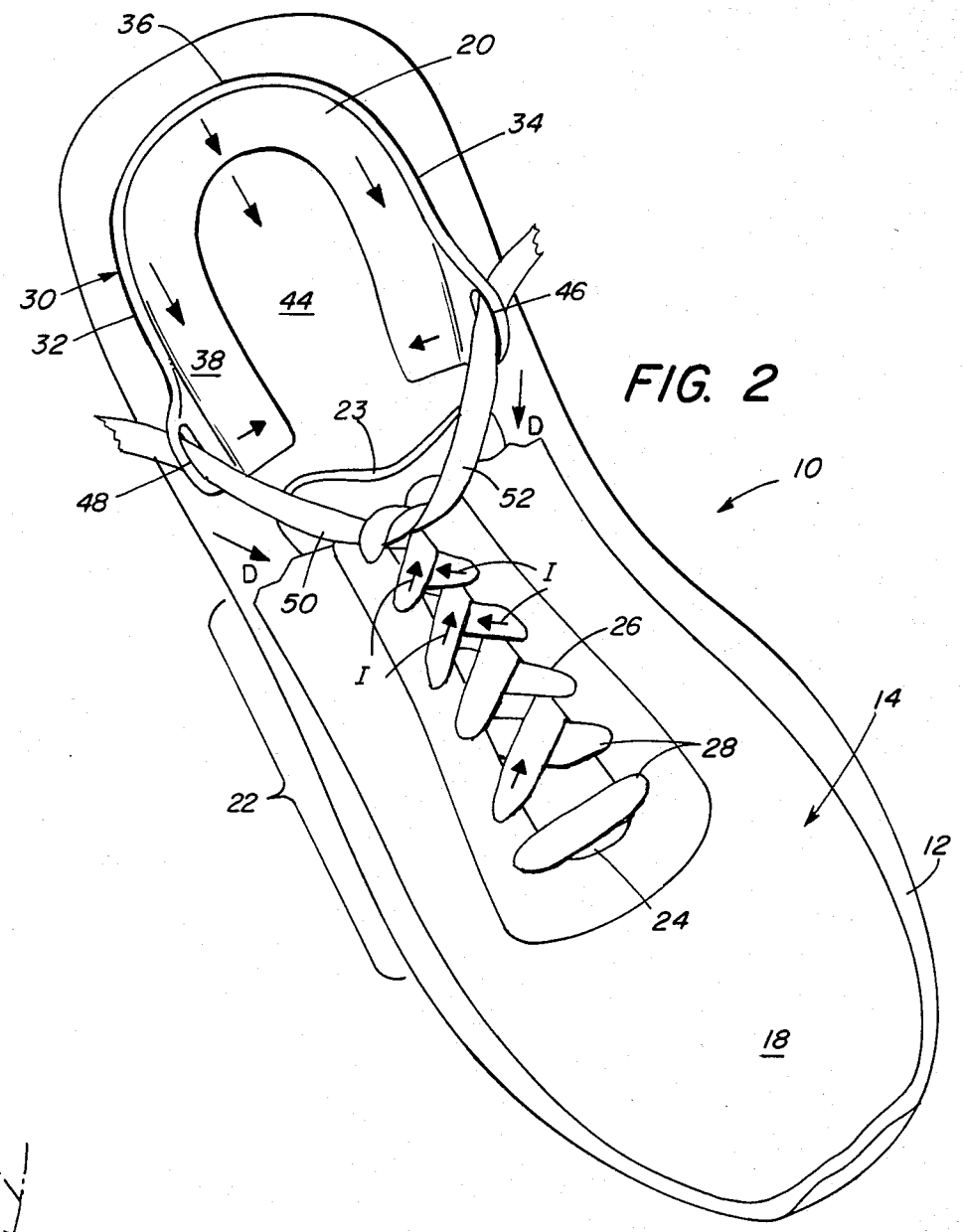
FIG. 2 is a plan view of the shoe in FIG. 1 with the heel portion of the upper cut-away to expose the external counter.

Referring to FIGS. 1 and 2, athletic shoe 10 comprises sole 12 and shoe upper 14 connected to the sole and adapted to receive and confine foot 15 of the wearer 16. Upper 14 has a toe portion 18, a heel portion 20 and an intermediate connecting portion 22, which includes tongue 23 and a U-shaped opening 24 secured by shoelace 26 extending between lace engaging eyelets 28 disposed around the periphery of the opening.

Extending about the shoe upper 14 in the heel portion 20, is external cup-form shoe counter 30, typically molded of synthetic material, e.g., polypropylene, which has upwardly extending side portions 32, 34 and rear portion 36 and a base portion 38 extending beneath the heel portion of the upper, above sole 12 to form a cup about the angled juncture of the rear surface 40 and bottom surface 42 of the wearer's foot. The cup-form configuration of counter 30 is best seen in FIG. 3. In preferred embodiments, a forwardly directed aperture 44 is defined in the base portion 38 of counter 30 which allows the forward sections of side portion 32, 34 to move independently, as is discussed below.

At the forward end of side portions 32, 34, eyelets 46, 48 are defined in the molded body of external cup-form counter 30 for receiving the ends 50, 52 of shoelace 26 therethrough before the lace is securely tied at 53 proximal to the angled juncture of the upper surface 54 of the foot and the front surface 56 of the leg.

The molded surface defining the eyelets is rounded and, as seen in FIG. 2, is angled outward, both features to facilitate easy passage of the lace ends therethrough.

OPERATION

Referring back to FIGS. 1 and 2, wearer 16 inserts foot 15 into the upper 14 of shoe 10. Lace 26 across opening 24 is drawn tightly through peripheral eyelets 28 to exert a closing force I, shown by arrows in FIG. 2, to close intermediate portion 22 of shoe 10 about the foot.

Lace ends 50, 52 are threaded through eyelets 46, 48, respectively, of cup-form counter 30, and the ends are entwined at 53 and pulled tightly. The rounded, outwardly angled structure of eyelets 46, 48 facilitates lace tightening as the drawing force D exerted on the lace ends, shown by arrows in FIGS. 1 and 2, is transmitted to the upper laced portion with a minimum of friction. As eyelets 46, 48 are integrally molded as part of external counter 30, all desired force may be applied, typically up to the breaking point of the lace 26, because the eyelets are not subject to being loosened or breaking away from the shoe. When sufficiently tight, the lace ends 50, 52 are tied at 53 proximal to the angled juncture of the front surface 56 of the leg and the top surface 54 of the foot.

Figure 4:
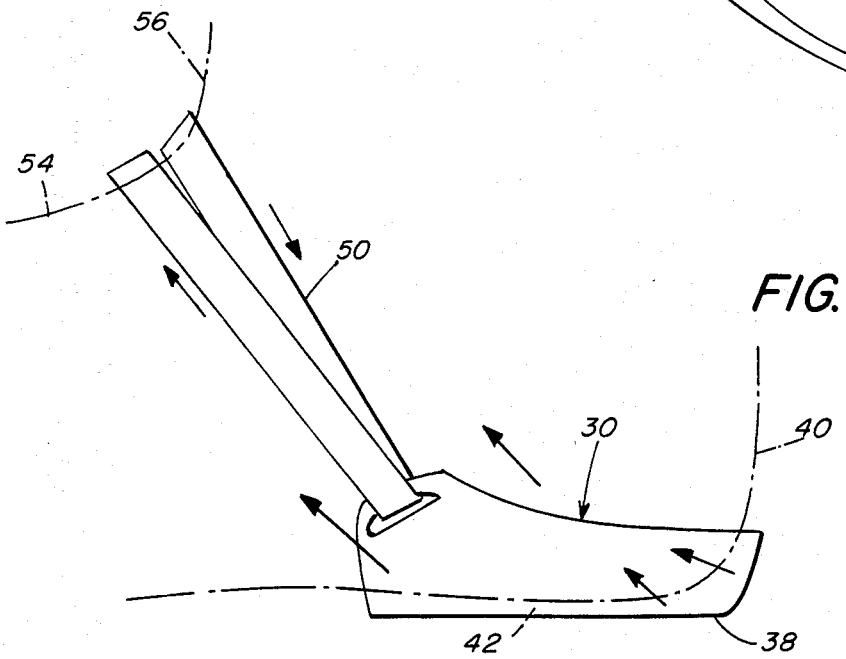
FIG. 4 is a representation of the cupping relationship of the counter to the wearer's heel.

The force D exerted by shoelace ends 50, 52 in counter eyelets 46, 48 respectively, draws the forward side portions 32, 34 of counter 30 toward the juncture of surfaces 54, 56. The forces exerted are transmitted through the body of the cup-form, rigid counter 30 to draw the entire counter forward and upward, as shown by the arrows. The rear section of the counter cups the lower rear of the wearer's heel of the juncture of surfaces 40, 42, thus tightly gripping the shoe about the foot in a manner, shown representatively in FIG. 4, not subject to slipping due to this cupping relationship. The side portions 32, 34 of counter 30 are also drawn somewhat inwardly, independent of the opposed side portion, toward the foot axis to more effectively cup about the foot heel pad to grip the foot.

What is claimed is:

1. In a laced athletic shoe comprising a sole, and a shoe upper connected to said sole and adapted to receive and confine a wearer's foot, said upper having a toe portion, a heel portion and an intermediate connecting portion therebetween, said intermediate connecting portion including a U-shaped opening extending rearwardly from proximate the toe portion secured by laces extending between lace-engaging eyelets along the periphery of said opening, said heel portion including a counter having at least a rearward portion and forwardly extending side portions, and said heel portion further including a pair of side eyelets affixed to the forwardly extending side portions of said counter for receiving the end portion of said laces therethrough, whereby when said laces are drawn tightly through said eyelets, said intermediate connecting portion and said heel portion in the vicinity of said side eyelets are drawn close to the wearer's foot, the improvement wherein said counter is a rigid external counter of cup-form configuration, including a base portion extending from said rearward and forwardly extending side portions beneath the wearer's foot above the sole, and said heel portion side eyelets are defined in the forwardly extending surfaces of said external cup-form counter, the height of each said side portion of said external counter above the sole in the region of the respective side eyelet being greater than the height of said side portion at a point more remote from said eyelet, whereby when said laces are drawn tightly, said rigid cup-form counter is drawn against the immediate bottom rear portion of the wearer's foot and the rearward and upwardly extending side portions of said counter are drawn against the rear and side portions of the wearer's foot, all in the direction of the laced upper intermediate connecting portion of the shoe to snugly grip the shoe about opposed sides of the wearer's foot to eliminate movement of said foot within said shoe.

2. The laced athletic shoe of claim 1 wherein a forwardly directed aperture is defined in the base surface of said external counter to enable the forwardly extending side portions of said counter to independently move to closely conform to the sides of the wearer's foot when said laces are drawn tightly.

3. The laced athletic shoe of claim 1 wherein at least a portion of the surface of said external counter defining said side eyelet is disposed at an angle outward from the side surface of said heel portion to facilitate passage of said laces therethrough.

4. For use in laced athletic footwear, in a shoe counter adapted to be disposed externally of the shoe upper in the heel portion of the footwear above the sole as a heel portion reinforcing element, said counter having a base portion extending beneath the heel of the wearer and a continuous wall portion extending upwardly along both the sides and about the rear of the heel portion to cup said heel portion, the improvement wherein said external heel portion reinforcing counter further includes an eyelet defined in each side wall of said counter, said eyelets being adapted to receive laces therethrough for applying a force to said eyelet in a forward direction, and said eyelets being adapted to transmit said force to said counter, and the height of each said side portion of said external counter above the base portion in the region of the respective side eyelet being greater than the height of said side portion at a point more remote from said eyelet.

5. The laced athletic shoe of claim 4 wherein a forwardly directed aperture is defined in the base surface of said external counter to enable the forwardly extending side portions of said counter to independently move to closely conform to the sides of the wearer's foot.

6. The laced athletic shoe of claim 4 wherein at least a portion of the surface of said external counter defining said side eyelet is disposed at an angle outward from the side surface of said counter.

* * * * *